United States Patent [19]

Lawrence et al.

[11] Patent Number: 4,679,774

[45] Date of Patent: Jul. 14, 1987

[54] FLUID CONDUIT COUPLING FOR A METALLURGICAL CONVERTER TRUNNION

[75] Inventors: Craig J. Lawrence, Nazareth; John J. Ferriola, Fogelsville, both of Pa.

[73] Assignee: Bethlehem Steel Corp.

[21] Appl. No.: 797,567

[22] Filed: Nov. 13, 1985

[51] Int. Cl.[4] ..... C21C 5/50

[52] U.S. Cl. ..... 266/246; 266/218

[58] Field of Search ..... 266/246, 247, 248, 245, 266/241, 218, 224

[56] References Cited

U.S. PATENT DOCUMENTS 4,055,335 10/1977 Fisher ..... 266/245

4,098,497 7/1978 Weihbold ..... 266/245

4,284,266 8/1981 Nagati ..... 266/246

4,387,884 6/1983 Seki et al. ..... 266/246

4,428,564 1/1984 Nagati ..... 266/246

OTHER PUBLICATIONS

*The American College Dictionary*, p. 380, 12/70.

*Primary Examiner*—L. Dewayne Rutledge

*Assistant Examiner*—S. Kastler

*Attorney, Agent, or Firm*—John I. Iverson

[57] ABSTRACT

A coupling for fluid conduits contained in a hollow trunnion of a basic oxygen furnace. The coupling is used to connect a plurality of fluid supply conduits to a plurality of fluid distribution conduits in the basic oxygen furnace.

6 Claims, 3 Drawing Figures

FLUID CONDUIT COUPLING FOR A METALLURGICAL CONVERTER TRUNNION

BACKGROUND OF THE INVENTION

This invention relates to the construction of basic oxygen converters used for the production of steel. It relates particularly to a fluid coupling used in the trunnion pins of a basic oxygen furnace. The coupling is used to connect a number of fluid supply conduits to a member of fluid distribution conduits used in the operation of the basic oxygen furnace.

In recent years, there has been a trend to injecting a number of reactive and non-reactive gases through the bottom of the basic oxygen furnace, which gases are most conveniently supplied through a hollow trunnion pin and then to gas distribution conduits connected to tuyeres in the bottom of the furnace. In addition, some components of the basic oxygen furnace are water-cooled to prolong the service life of these components. The cooling water is also frequently supplied through a hollow trunnion pin. Supplying both the gases and the cooling water through the hollow trunnion pin permits the furnace to rotate from a vertical operating position to an inclined charging or discharging position without the interference of a number of external gas and cooling water supply lines.

Since the trunnion pins support the tremendous weight of the furnace and the molten steel in the furnace, it is important that the several fluid supply systems be installed in such a manner that their maintenance and repair will not require the disassembly of the supporting trunnion pins.

In the past there have been a number of ideas patented relating to the handling of fluids in a hollow trunnion pin of a basic oxygen furnace. The most significant of these patents are:

U.S. Pat. No. 3,795,389—Kennedy; 1974,
U.S. Pat. No. 4,098,497—Weihbold; 1978,
U.S. Pat. No. 4,138,097—Farber; 1979,
U.S. Pat. No. 4,284,266—Nagati; 1981,
U.S. Pat. No. 4,325,540—Seki Et Al; 1982,
U.S. Pat. No. 4,387,884—Seki Et Al; 1983.

These patents generally describe various types of fluid conduit joints or couplings that are free to rotate when the furnace rotates on its trunnions. However, the fluid conduit joints or couplings shown in these prior patents are complex and do not permit easy routine maintenance of the fluid supply and distribution conduits. The designs described in these prior patents often require a complete disassembly of the entire trunnion pin to replace or repair a gas distribution conduit. Such a complete disassembly requires the furnace be taken out of service for an extended period of time.

A further disadvantage of the rotary joints or couplings described in these prior patents is that they tended to leak cooling water during service. These joints and couplings usually used O-rings as seals between the several components to permit rotary movement. The O-rings frequently failed prematurely, causing a leak. The explosive potential of water and molten steel is well known and therefore such rotary joints and couplings were not favored by the steelmakers.

SUMMARY OF THE INVENTION

It is an object of this invention to provide a coupling for the fluid conduits contained in the hollow trunnion pins of a basic oxygen furnace that is simple in construction and permits easy maintenance and repair of the fluid supply conduits and fluid distribution conduits, while the furnace is still in service.

It is a further object of this invention to provide a coupling that will prevent the leakage of cooling water.

It is a still further object of this invention to provide a coupling that can be easily adapted to many existing basic oxygen furnaces.

It has been discovered that the foregoing objectives can be attained by a coupling assembly comprising an outer water jacket member having a flanged tubular extension on one end, an inner water jacket member flanged at both ends and secured to the trunnion pin, a tubular sleeve member flanged at one end and spaced within the inner water jacket member and the hollow trunnion pin, a water jacket spacer member flanged at both ends and secured to the inner water jacket member and the outer water jacket member, the water jacket spacer member being split longitudinally into two flanged sections secured to each other, and a plurality of individual fluid conduits within the tubular sleeve member.

DESCRIPTION OF PREFERRED EMBODIMENT OF THE INVENTION

Figure 1:
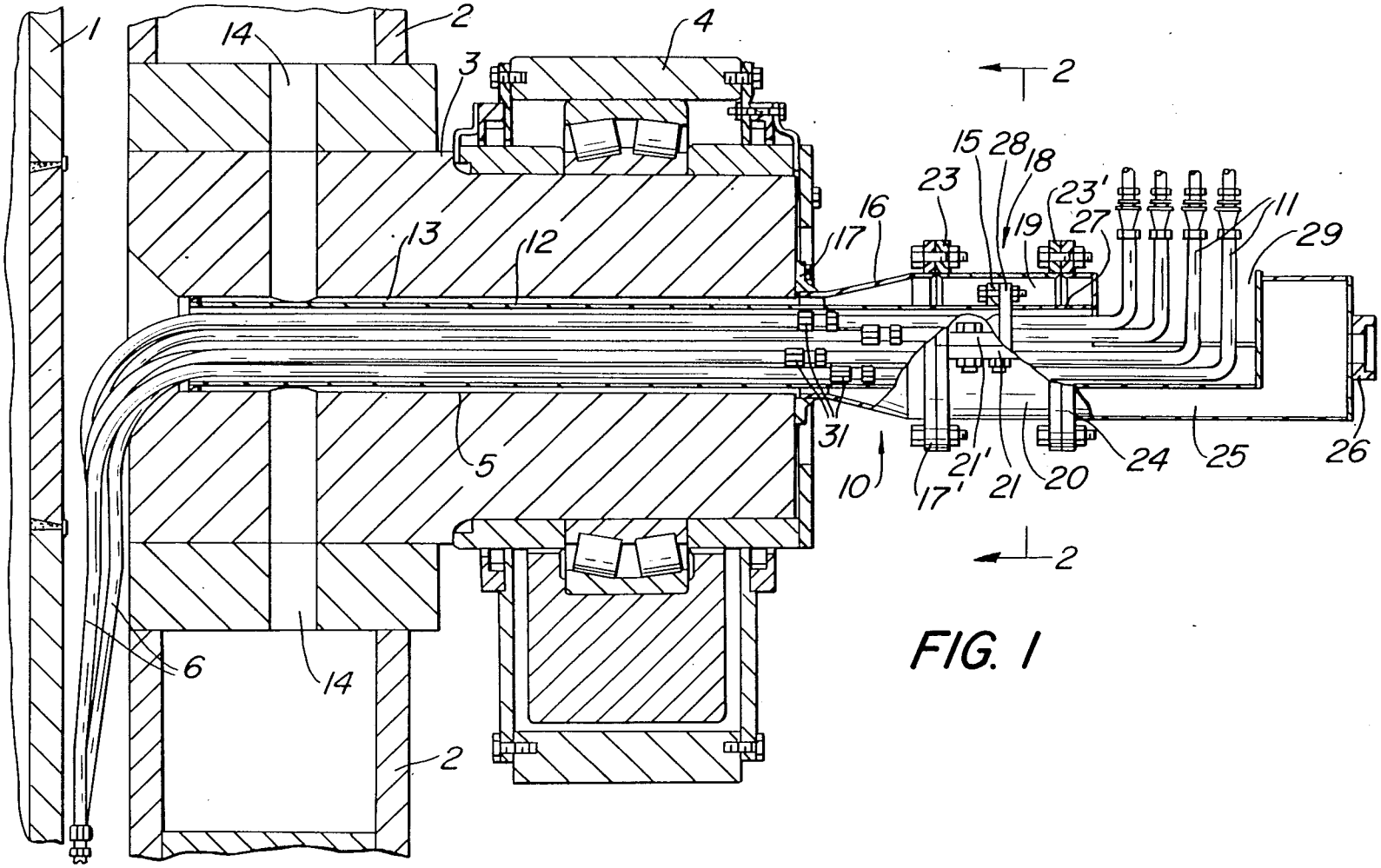
FIG. 1 is a cross sectional view of the coupling of this invention installed in the hollow trunnion pin of a basic oxygen furnace
Figure 2:
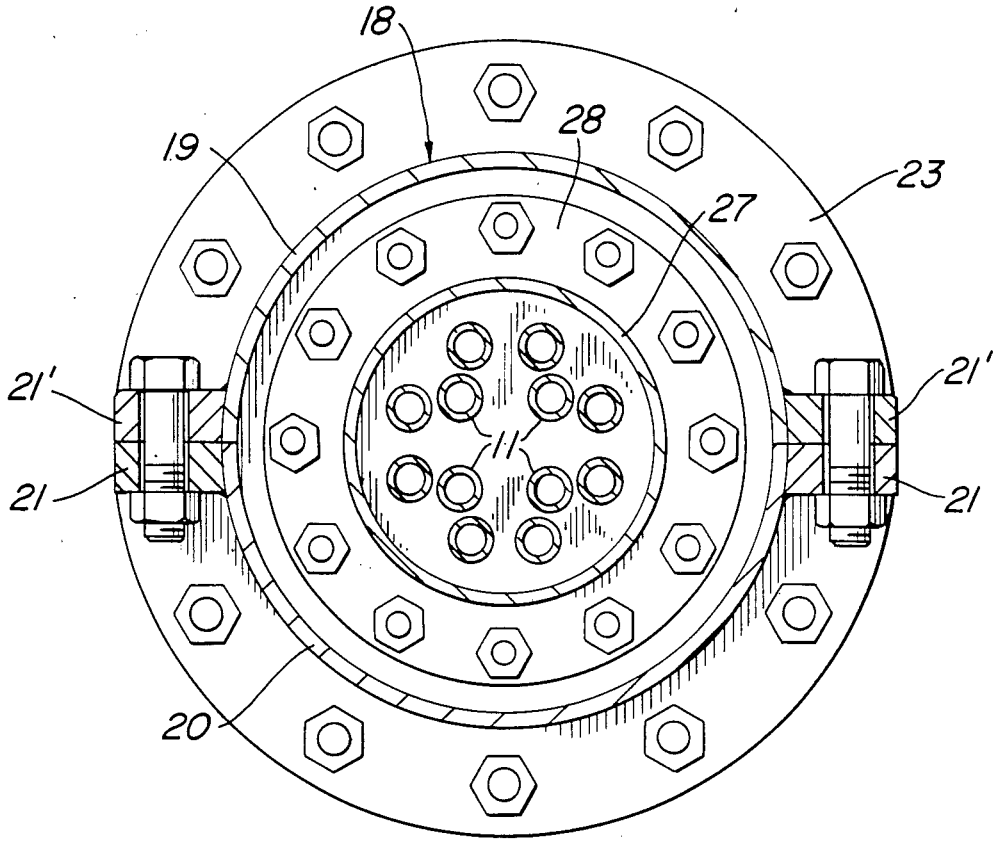
FIG. 2 is a section taken along the vertical plane A.A. of FIG. 1.

As shown in FIGS. 1 and 2, a preferred embodiment of the coupling of this invention is shown as used with a basic oxygen steelmaking furnace. It could be used in other apparatus where a number of fluid distribution conduits need to be connected to fluid supply lines and protected from high temperatures by cooling water.

In FIG. 1, a portion of the steel shell forming the body of the refractory lined furnace is shown at 1. The furnace is supported in a steel trunnion ring 2 which is internally water-cooled. Secured to the trunnion ring 2 are a pair of trunnion pins 3 journaled in bearings 4 which permit the entire furnace to tilt for charging and discharging.

At least one of the trunnion pins 3 has a hollow bore 5 to permit the installation of a plurality of flexible fluid distribution conduits 6 that extend through the hollow bore 5 of the trunnion pin 3 to the open space between the inside of the trunnion ring 2 and the outside of the steel furnace shell. The flexible fluid distribution conduits 6 follow the outside of the furnace shell 1 to the furnace bottom where they are connected to fluid manifolds and tuyeres (not shown). As shown in FIGS. 1 and 2 there may be as many as a dozen of such flexible fluid distribution conduits 6 within the hollow bore of the trunnion pin 3. The conduits 6 are used to carry both reactive gases, such as oxygen and carbon dioxide and non-reactive gases such as nitrogen and argon. They could also be used to carry liquid hydrocarbons which are sometimes used as a coolant for the tuyeres in the bottom of the furnace.

The coupling assembly 10 of this invention is used to facilitate the connection of the fluid distribution conduits 6 to a plurality of fluid supply conduits 11 immediately adjacent to the outer end of the hollow trunnion pin 3.

The coupling assembly 10 comprises a number of interacting components. An elongated tubular steel sleeve member 12 spaced within the hollow bore of the trunnion pin 3. Sufficient space is provided between the outside of the tubular sleeve member 12 and the wall of the hollow bore 5 of the trunnion pin 3 to provide a cooling water passage 13. Tubular sleeve member 12 is welded at one end to the wall of the trunnion bore 5 to seal the end of the cooling water passage 13. The trunnion pin 3 has a pair of additional cooling water passages 14 to connect the cooling water passage 13 with the hollow interior of the trunnion ring 2. The cooling water circulated within the circumference of the trunnion ring 2 is then discharged through a water passage in the trunnion pin 3 on the other side of the furnace (not shown). The tubular sleeve member 12 extends beyond the end of the trunnion pin 3 and terminates at its outer end in a boltable flange 15.

An inner water jacket member 16 is flanged at both ends, flange 17 is bolted to the outer end of the trunnion pin 3 and the inner water jacket member 16 is spaced around the tubular sleeve member 12 to provide a continuation of the cooling water passage 13. Bolted to the outer flange 17' of the inner water jacket member 16 is a water jacket spacer member 18 with flanges 23 and 23' and split longitudinally into two sections 19 and 20 which are secured to each other by bolted flanges 21 and 21'. The outer flange 23' of the water jacket spacer member 18 is bolted to a flange 24 formed on the inner end of an outer water jacket member 25.

Figure 3:
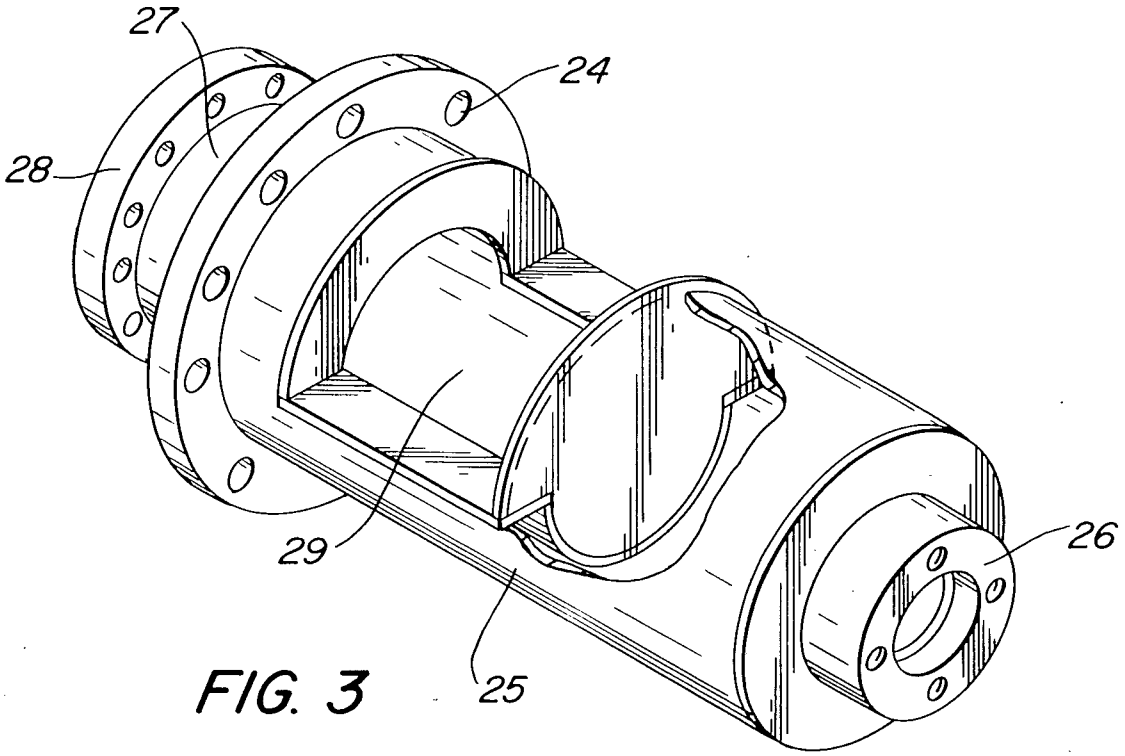
FIG. 3 is an isometric view, partially in section of the outer water jacket member.

As shown in FIG. 3, the outer water jacket member 25 is a water tight box having a cooling water inlet connection 26 at its outer end. The outer water jacket member 25 has a tubular extension 27 which terminates in a flange 28 which is bolted to the flange 15 of the tubular sleeve member 12. The outer water jacket member also has a flange 24 bolted to the outer flange 23' of the water jacket spacer member 18. As shown in FIG. 3, the outer water jacket member 25 has a central cut out portion 29 to provide access for a plurality of fluid supply conduits 11 into the hollow interior of the tubular extension 27 and then into the interior of the tubular sleeve member 12.

The coupling assembly 10 of this invention provides a simple arrangement for replacing one or more of the flexible fluid distribution conduits 6. To get access to a flexible fluid distribution conduit 6, the flanges 23 and 23' of the water jacket spacer member 18 are unbolted. Next the flanges 21 and 21' are unbolted permitting the upper and lower sections 19 and 20 to be separated and removed, providing access for the unbolting of flanges 15 and 28. The ends of the flexible fluid distribution conduits 6 at the bottom of the furnace (not shown) are disconnected from the furnace manifolds or tuyeres allowing the bundle of distribution conduits 6 and the outer water jacket member 25 to be easily pulled out and away from the furnace and exposing the connections 31 that join the flexible fluid distribution conduits 6 to the fluid supply conduits 11. When the repair or maintenance is completed, the procedure is reversed.

It can be seen that the coupling of this invention provides a simple, leakproof means for connecting and protecting within water cooled jackets a number of fluid conduits.

While the present invention has been described and illustrated with our preferred embodiment, it will be appreciated by those skilled in this art, after understanding this invention, that various changes and modifications may be made without departing from the spirit and scope of this invention. It is therefore intended that all such changes and modifications will be included in the following claims.

We claim:

1. In a tiltable metallurgical converter having a hollow trunnion pin, a coupling assembly to convert fluid supply conduits to fluid distribution conduits locates within such hollow trunnion pin, said coupling assembly comprising:

(a) an outer water jacket member having a flanged tubular extension on one end, (b) an inner water jacket member flanged at both ends and secured to said trunnion pin, (c) a tubular sleeve member flanged at one end and spaced within said inner water jacket member and said hollow trunnion pin, (d) a water jacket spacer member flanged at both ends and secured to said inner water jacket member and said outer water jacket member, said water jacket spacer member split longitudinally into two flanged sections secured to each other, and (e) a plurality of individual eccentric flexible fluid conduits within said tubular sleeve member.

2. The coupling of claim 1 in which said outer water jacket is secured to the outer end of said water jacket spacer member by bolted flanges.

3. The coupling of claim 1 in which the diameter of the flange at the end of said tubular sleeve member is less than the inner diameter of said water jacket spacer member.

4. The coupling of claim 1 in which the individual eccentric flexible fluid conduits exit from said coupling assembly through said outer water jacket member.

5. The coupling of claim 1 in which said tubular sleeve member is spaced inwardly from the inner wall of said hollow trunnion pin.

6. The coupling of claim 1 in which said individual eccentric flexible fluid conduits each have a coupling.

* * * * *